United States Patent [19]

Darner

[11] Patent Number: 4,764,909

[45] Date of Patent: Aug. 16, 1988

[54] HYDROGEN GENERATOR

[75] Inventor: Charles L. Darner, Orlando, Fla.

[73] Assignee: The United States of America as represented by the Secretary of the Navy, Washington, D.C.

[21] Appl. No.: 851,141

[22] Filed: Aug. 7, 1969

[51] Int. Cl.[4] ..... H04R 1/44

[52] U.S. Cl. ..... 367/171

[58] Field of Search ..... 340/5, 8, 8 D; 181/0.5 A, 0.5, 110, 115; 367/87, 140, 141, 157, 166, 171, 174

[56] References Cited

U.S. PATENT DOCUMENTS 3,210,724 10/1965 Jones et al. ..... 340/5 X 3,525,977 8/1970 Darner ..... 367/171

*Primary Examiner*—Theodore M. Blum

*Assistant Examiner*—Bernarr Earl Gregory

*Attorney, Agent, or Firm*—Robert W. Adams

[57] ABSTRACT

The power output and thus the range of sonar apparatus is limited by cavitation of the water surrounding a sonar transducer at high output power levels. The invention "strengthens" the water surrounding a sonar transducer by increasing the hydrogen content to permit a many fold increase in the transducer output power before cavitation occurs.

6 Claims, 1 Drawing Sheet

HYDROGEN GENERATOR

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED APPLICATIONS

This application refers to the inventor's U.S. application Ser. No. 693,694, filed Dec. 21, 1967, now U.S. Pat. No. 3,525,977.

BACKGROUND OF THE INVENTION

The invention is in the field of sonar. In the prior art, the high power acoustic output of a sonar transducer has been severely limited by cavitation in the water surrounding the transducer. Cavitation interferes with the transfer of energy from the transducer to the water. Sonar transducers affixed to ships and submarines are usually enclosed in a streamlined dome or bubble which contains water. The cavitation level of the water in the dome is critical, because this water is the medium through which the energy developed by the transducer is conveyed to the water outside the dome. Various expedients such as degassing the water by applying a surface vacuum, prepressurizing the dome to high hydrostatic pressures, processing to attain ultra-pure water, etc., have been tried. These expedients are in general expensive and require complex and cumbersome apparatus. Pressurization can rupture the dome or distort its streamlined shape. Applicant's invention solves this problem of the prior art by providing simple, convenient, inexpensive, and effective means for retarding cavitation in water.

SUMMARY OF THE INVENTION

A container permeable to gases, such as a rubber bag, is filled with a quantity of steel particles, an alkaline cell, and distilled water. Oxygen and hydrogen are generated by electrolysis of the water. The oxygen generated combines with the steel particles to form rust. The hydrogen supersaturates the water in the bag, permeates the bag and passes to the water outside. The added hydrogen strengthen the water in the dome to the extent that a sonar transducer immersed therein may be operated at greatly increased power levels without inducing cavitation.

DESCRIPTION OF THE PREFERRED EMBODIMENT

Figure 1:
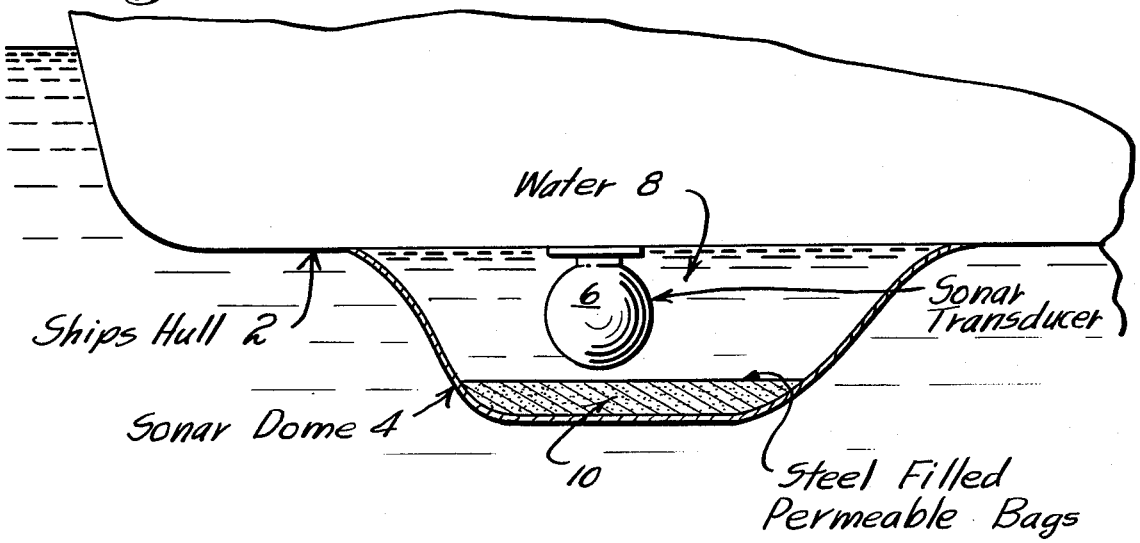
FIG. 1 shows a typical environment of the invention.

In FIG. 1 is shown a closed sonar dome 4 housing sonar transducer 6. Sonar dome 4 is attached to a ship's hull 2 and is filled with water 8 which surrounds sonar transducer 6. Water 8 is preferably "strengthened" by the process taught in applicant's copending application Ser. No. 693,694 filed Dec. 21, 1967, now U.S. Pat. No. 3,525,977. This process employs steel-filled permeable bags 10 which are immersed in the water in a sonar dome. The steel in the bags 10 strengthens the water around transducer 6 by combining with oxygen in the water to reduce its oxygen content. The present invention strengthens raw water or further strengthens water which has been strengthened by the process of applicant's copending application.

Figure 2:
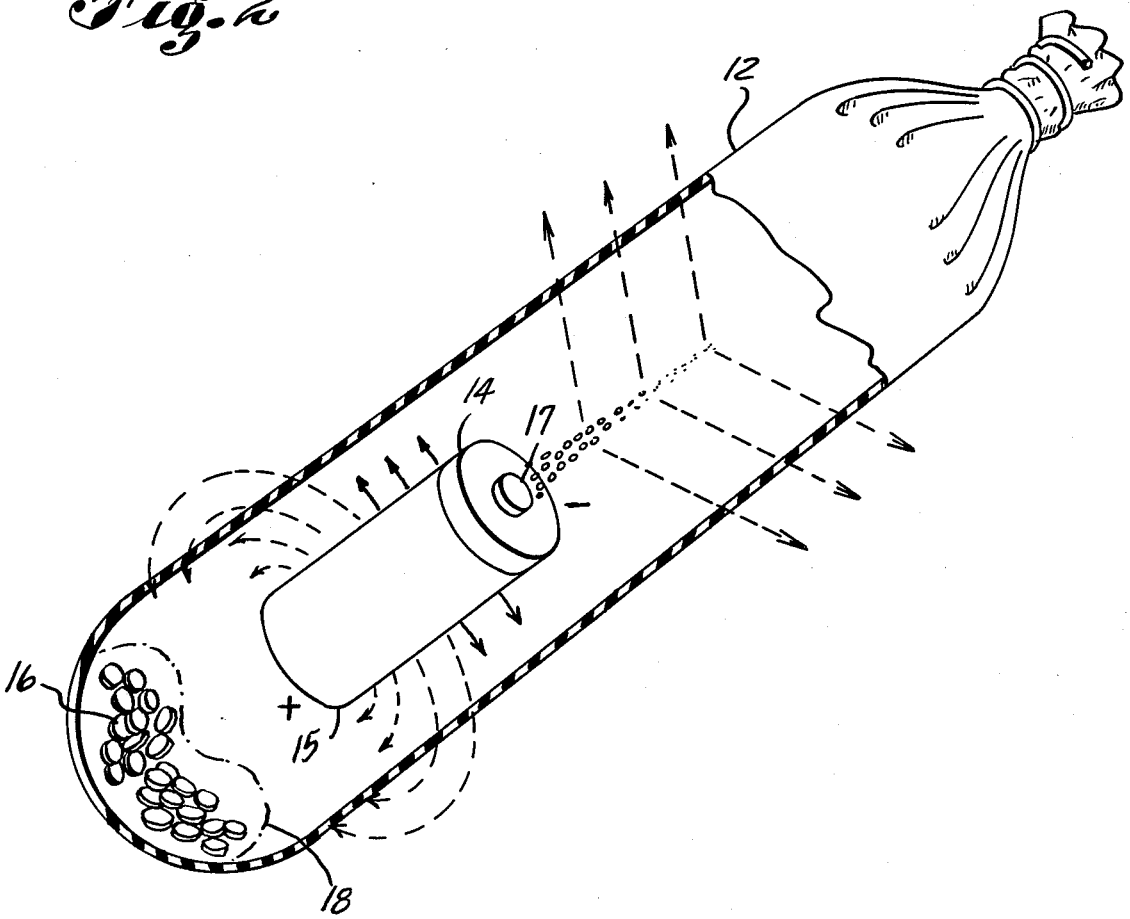
FIG. 2 illustrates the structure of the invention.

In FIG. 2, the invention is shown as a water-filled rubber bag 12 which is permeable to $H_2$ and $O_2$. The water in bag 12 is preferably distilled water. A quantity of steel particles 16 are positioned in bag 12 in the manner shown. An alkaline cell 14 which has the polarity shown is positioned in bag 12. If steel particles of such shape as can puncture the bag are used, they may be wrapped in protective material 18 which may be, for example, tissue paper. Bag 12 is closed at the top by tying, clamping, or sealing by any suitable means.

A plurality of bags 12 are prepared in the manner described and placed in a sonar tank or dome such as dome 4 of FIG. 1, to strengthen the water therein. The number of bags used will depend on the amount of water treated and the degree of strengthening required.

When bags 12 are prepared, steel particles 16 are wrapped in material 18 and placed in the bag, cell 14 is inserted in the position shown in FIG. 2, and bag 12 is filled with distilled water, then the open end of bag 12 is closed. Hydrogen and oxygen are generated in the bag by electrolysis. Gas production is minimized by the low conductivity of the distilled water in bag 12. The positive case 15 of cell 14 has an area many times that of cathode 17 and produces oxygen in molecular form (without bubbles). The oxygen is quickly absorbed by the surrounding water, particularly when the water has previously been deoxygenated as taught in applicant's aforementioned copending application. The flow of oxygen will be toward the steel particles which now combine with the oxygen to form rust. The negative cathode produces hydrogen in the form of microbubbles sufficiently small to have a high internal pressure because of the surface tension of the water. These microbubbles are partially absorbed by and supersaturate the water in the bag. Hydrogen in this water then permeates the bag, which has a relatively large surface area in contact with the outside water. The addition of the hydrogen to the water in the dome retards the onset of cavitation, enabling sonar transducer 6 to transmit at much higher power levels than if the hydrogen were not added. The mechanism by which the process strengthens water is not presently understood.

The invention may be constructed of inexpensive and readily available materials. For example, a small rubber balloon may be used for bag 12, steel particles 16 may be the small steel discs that are a byproduct of manufacture of straps and bands, and cell 14 may be a small alkaline cell such as is interchangeable with "flashlight batteries", with the outer polarity-reversing case removed. The amount of steel added to the bag will depend on the capacity of the cell and size of the bag but, in general, should be sufficient to combine with the excess oxygen produced.

The cost of the invention is negligible; one unit will treat as much as fifty gallons of water. The bag is easily installed in closed sonar domes, tanks, etc., because it can be inserted through a relatively small opening. It simply and easily solves a serious problem of the prior art.

What is claimed is:

1. In a sonar apparatus, the improvement comprising:
a sonar dome, a quantity of water within said dome, a sonar transducer, said transducer being immersed in said water whereby the output energy of said transducer is transmitted through said water and said dome, strengthening means for strengthening said water to retard the onset of cavitation in said water at high output power levels of said transducer, said strengthening means comprising means for increasing the hydrogen content of said water whereby the onset of cavitation is retarded.

2. The apparatus of claim 1, wherein said means for increasing the hydrogen content of said water comprises hydrogen generator means, at least one of said generator means being immersed in said water, whereby hydrogen generated by said generator means is added to said water.

3. The apparatus of claim 2, wherein said hydrogen generator means generates hydrogen through the process of electrolysis.

4. The apparatus of claim 3, said hydrogen generator means comprising a permeable container, said container containing a quantity of steel particles, a quantity of distilled water, an alkaline cell, said cell producing an electric current to promote electrolysis.

5. The apparatus of claim 4, wherein said permeable container is permeable to hydrogen and to oxygen.

6. The apparatus of claim 5, the quantity of said steel particles being sufficient to combine with the oxygen produced by electrolysis.

* * * * *